US010822946B2

(12) United States Patent
Young

(10) Patent No.: US 10,822,946 B2
(45) Date of Patent: Nov. 3, 2020

(54) DRILLING RIG GAS TRAP TESTING

(71) Applicant: Halliburton Energy Services, Inc., Houston, TX (US)

(72) Inventor: Martin Strachan Young, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 15/776,992

(22) PCT Filed: Jan. 25, 2016

(86) PCT No.: PCT/US2016/014663

§ 371 (c)(1),
(2) Date: May 17, 2018

(87) PCT Pub. No.: WO2017/131606

PCT Pub. Date: Aug. 3, 2017

(65) Prior Publication Data

US 2018/0328173 A1 Nov. 15, 2018

(51) Int. Cl.

| | |
|---|---|
| ***E21B 49/08*** | (2006.01) |
| ***E21B 49/00*** | (2006.01) |
| ***E21B 21/06*** | (2006.01) |

(52) U.S. Cl.

CPC ..... *E21B 49/086* (2013.01); *E21B 21/067* (2013.01); *E21B 49/005* (2013.01)

(58) Field of Classification Search

CPC ..... E21B 49/086

USPC ..... 73/152.23

See application file for complete search history.

(56) References Cited

U.S. PATENT DOCUMENTS

| | | | | |
|---|---|---|---|---|
| 2002/0020215 | A1 | 2/2002 | Nelson et al. | |
| 2009/0008560 | A1* | 1/2009 | Gunn | E21B 21/01 250/343 |
| 2009/0090197 | A1* | 4/2009 | Finlay | G01N 1/2214 73/863.12 |
| 2009/0199618 | A1 | 8/2009 | Evrard | |
| 2010/0223975 | A1* | 9/2010 | Lueck | G01N 33/4972 73/1.06 |
| 2012/0267115 | A1 | 10/2012 | Brown et al. | |
| 2015/0136961 | A1 | 5/2015 | Eddy et al. | |

OTHER PUBLICATIONS

International Search Report and The Written Opinion of the International Search Authority, or the Declaration, dated Oct. 21, 2016, PCT/US2016/014663, 13 pages, ISA/KR.

* cited by examiner

*Primary Examiner* — Walter L Lindsay, Jr.
*Assistant Examiner* — PhilipMarcus T Fadul
(74) *Attorney, Agent, or Firm* — Haynes and Boone, LLP

(57) ABSTRACT

Various embodiments disclosed relate to drilling rig gas trap gas sampling. In various embodiments, the present invention provides a method of gas sampling. The method includes flowing a gas sample from a sample container to a gas trap. The gas trap includes a mud inlet, a mud outlet, and a sample line fluidly connecting the gas trap to a gas detector. The sample container is fluidly and sealably connected to the gas trap. The method includes flowing the gas sample in the gas trap to the gas detector via the sample line. The method includes detecting the gas sample with the gas detector.

17 Claims, 4 Drawing Sheets

DRILLING RIG GAS TRAP TESTING

PRIORITY

The present application is a U.S. National Stage patent application of International Patent Application No. PCT/US2016/014663, filed on Jan. 25, 2016, the benefit of which is claimed and the disclosure of which is incorporated herein by reference in its entirety.

BACKGROUND

Drilling mud systems for drilling rigs include a header box or flow-line gas trap to at least partially separate gas from the drilling mud returned to the surface. The gas trap includes agitation means such as spinning blades near the mud inlet that contact and agitate the mud to separate the mud from the gas. The gas trap includes a gas detector connected thereto to allow detection and measurement of gases in the drilling mud. The gas detector must be tested and calibrated on a regular basis. The current method for testing and calibration of the gas detector includes holding a gas sample source or a tube connected thereto underneath the mud inlet of a running gas trap until the gas detector has detected the gas sample. The spinning agitator of the gas trap is near the mud inlet, endangering the operator. Further, portions of the gas sample can escape, endangering the operator and sometimes causing failed gas sampling attempts.

BRIEF DESCRIPTION OF THE FIGURES

The drawings illustrate generally, by way of example, but not by way of limitation, various embodiments discussed in the present document.

DETAILED DESCRIPTION OF THE INVENTION

Figure 1:
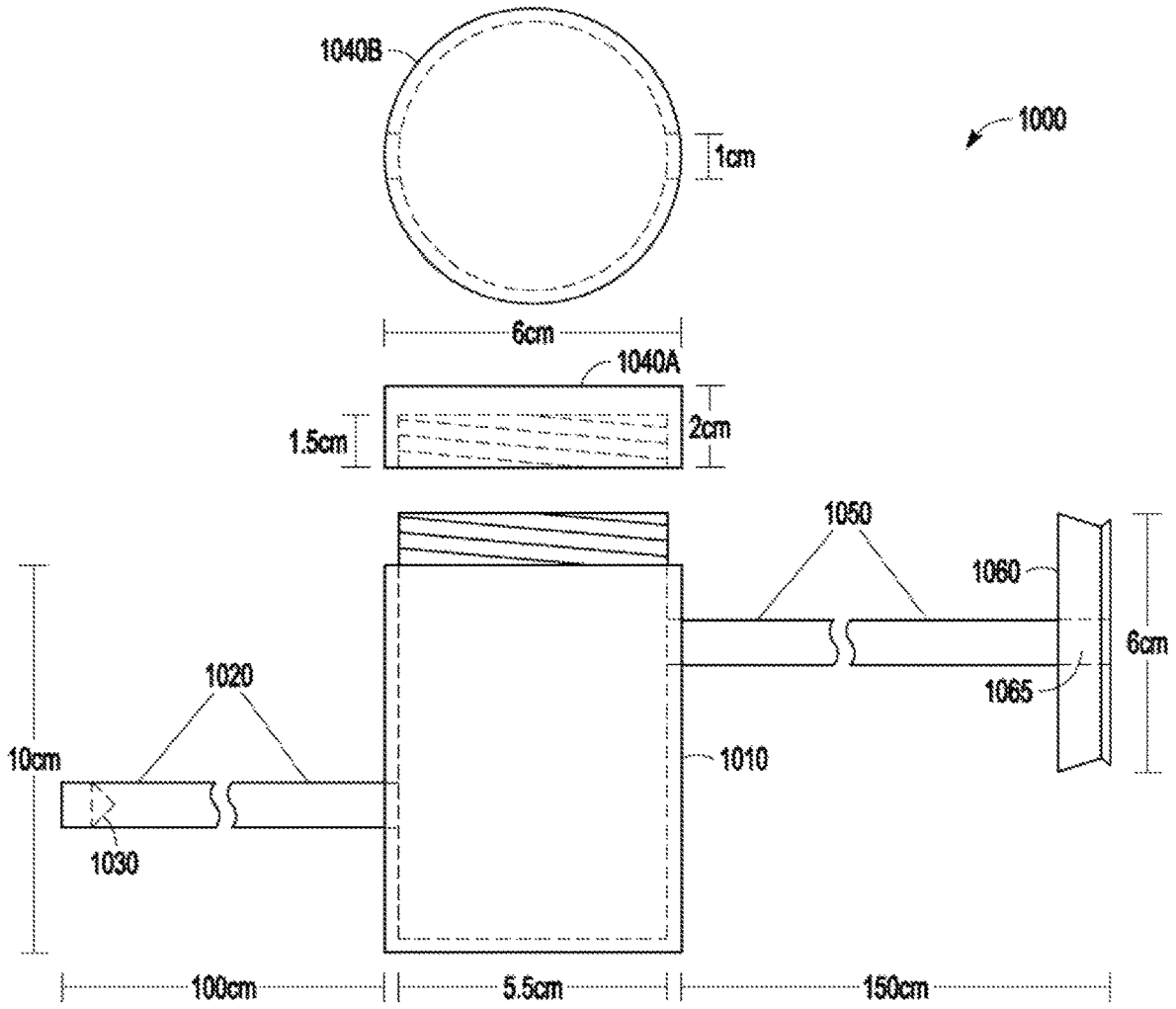
FIG. 1 illustrates a gas sampling apparatus, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

In this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

The term "hydrocarbon," "hydrocarbyl," or "hydrocarbylene," as used herein, refers to a molecule or functional group that includes carbon and hydrogen atoms. The term can also refer to a molecule or functional group that normally includes both carbon and hydrogen atoms but wherein all the hydrogen atoms are substituted with other functional groups. A hydrocarbyl group can be a functional group derived from a straight chain, branched, or cyclic hydrocarbon, and can be alkyl, alkenyl, alkynyl, aryl, cycloalkyl, acyl, or any combination thereof. Hydrocarbyl groups can be shown as $(C_a\text{-}C_b)$hydrocarbyl, wherein a and b are positive integers and mean having any of a to b number of carbon atoms. For example, $(C_1\text{-}C_4)$hydrocarbyl means the hydrocarbyl group can be methyl ($C_1$), ethyl ($C_2$), propyl ($C_3$), or butyl ($C_4$), and $(C_0\text{-}C_b)$hydrocarbyl means in certain embodiments there is no hydrocarbyl group.

The term "solvent" as used herein refers to a liquid that can dissolve a solid, liquid, or gas. Non-limiting examples of solvents are silicones, organic compounds, water, alcohols, ionic liquids, and supercritical fluids.

The term "downhole" as used herein refers to under the surface of the earth, such as a location within or fluidly connected to a wellbore.

As used herein, the term "drilling fluid" refers to fluids, slurries, or muds used in drilling operations downhole, such as during the formation of the wellbore.

As used herein, the term "subterranean material" or "subterranean formation" refers to any material under the surface of the earth, including under the surface of the bottom of the ocean. For example, a subterranean formation or material can be any section of a wellbore and any section of a subterranean petroleum- or water-producing formation or region in fluid contact with the wellbore. Placing a material in a subterranean formation can include contacting the material with any section of a wellbore or with any subterranean region in fluid contact therewith. Subterranean materials can include any materials placed into the wellbore such as cement, drill shafts, liners, tubing, casing, or screens; placing a material in a subterranean formation can include contacting with such subterranean materials. In some examples, a subterranean formation or material can be any below-ground region that can produce liquid or gaseous petroleum materials, water, or any section below-ground in fluid contact therewith.

In various embodiments, the present invention provides a method of gas sampling. The method includes flowing a gas sample from a sample container to a gas trap. The gas trap includes a mud inlet, a mud outlet, and a sample line fluidly connecting the gas trap to a gas detector. The sample container is fluidly and sealably connected to the gas trap. The method includes flowing the gas sample in the gas trap to the gas detector via the sample line. The method also includes detecting the gas sample with the gas detector.

In various embodiments, the present invention provides a method of gas sampling. The method includes flowing water into a sample container to react with calcium carbide therein to produce a gas sample. The method includes flowing the gas sample from the sample container to a gas trap. The gas trap includes a mud inlet, a mud outlet, and a sample line fluidly connecting the gas trap to a gas detector. The sample container is fluidly and sealably connected to the mud inlet or the mud outlet of the gas trap via a removable sealing connector. The method includes flowing the gas sample in the gas trap to the gas detector via the sample line. The method also includes detecting the gas sample with the gas detector.

In various embodiments, the present invention provides a method of gas sampling. The method includes opening a valve on a gas tank to flow a gas sample from inside the gas tank into a gas trap. The gas trap includes a mud inlet, a mud outlet, and a sample line fluidly connecting the gas trap to a gas detector. The gas tank is fluidly and sealably connected to the mud inlet or the mud outlet of the gas trap via a removable sealing connector. The method includes flowing the gas sample in the gas trap to the gas detector via the sample line. The method includes detecting the gas sample with the gas detector.

In various embodiments, the present invention provides a gas sampling apparatus. The gas sampling apparatus includes a sample container configured to flow a gas sample from the sample container to a gas trap. The sample container is configured to fluidly and sealably connect to the gas trap. The gas trap includes a mud inlet, a mud outlet, and a sample line fluidly connecting the gas trap to a gas detector. The gas trap is configured to flow the gas sample in the gas trap to the gas detector via the sample line for detection by the gas detector.

In various embodiments, the present invention provides a gas sampling apparatus. The gas sampling apparatus includes a sample container including calcium carbide therein. The sample container is configured such that water flowed into the sample container reacts with the calcium carbide to produce a gas sample that flows from the sample container to a gas trap. The gas trap includes a mud inlet, a mud outlet, and a sample line fluidly connecting the gas trap to a gas detector. The sample container is configured to fluidly and sealably connect to the mud inlet or the mud outlet of the gas trap via a removable sealing connector. The gas trap is configured to flow the gas sample in the gas trap to the gas detector via the sample line for detection by the gas detector.

In various embodiments, the present invention provides a gas sampling apparatus. The gas sampling apparatus includes a gas tank including a gas sample therein and a valve. The gas tank is configured such that opening the valve on the gas tank flows a gas sample from inside the gas tank into a gas trap. The gas trap includes a mud inlet, a mud outlet, and a sample line fluidly connecting the gas trap to a gas detector. The gas tank is configured to fluidly and sealably connect to the mud inlet or the mud outlet of the gas trap via a removable sealing connector. The gas trap is configured to flow the gas sample in the gas trap to the gas detector via the sample line for detection by the gas detector.

In various embodiments, the present invention provides a system for gas sampling. The system includes a gas detector. The system includes a gas trap including a mud inlet, a mud outlet, and a sample line fluidly connecting the gas trap to the gas detector. The system also includes a sample container that is fluidly and sealably connected to the gas trap. The sample container is configured to flow a gas sample from the sample container to the gas trap. The gas trap is configured to flow the gas sample in the gas trap to the gas detector via the sample line for detection by the gas detector.

The current method is for the user to hold a cup containing calcium carbide underneath a running gas trap mud inlet. The user must quickly add water to the cup with the other hand to create a chemical reaction. The user must then balance the hot cup, containing an exothermic reaction, underneath the gas trap mud inlet until the reaction is complete. Similarly, when testing with "cocktail gas" (e.g., ($C_1$-$C_5$)hydrocarbons) in a gas bottle, the user must hold a gas bottle with one hand whilst directing a plastic tube into the gas trap mud inlet with the other. The user must repeat this process using fresh reactants until the detector within the logging unit has detected the reaction gas. In various embodiments, the present invention provides certain advantages over other methods, apparatus, and systems for gas sampling, at least some of which are unexpected. For example, in various embodiments, the present invention allows a user to carry out gas sampling in a safer manner than current methodology. In various embodiments, the present invention can avoid or reduce exposure of workers to harmful chemicals used to generate the gas sample. In various embodiments, the present invention can avoid or reduce exposure of workers to potentially harmful drilling mud. In various embodiments, the present invention can avoid or reduce exposure of workers to toxic and potentially dangerous gas samples. In various embodiments, the present invention can avoid or reduce exposure of the hands and fingers of workers to a dangerous agitator assembly in the gas trap. In various embodiments, the present invention can provide a more "hands-free" way to perform gas sampling, which can allow a worker to maintain more secure contact with the surroundings, such as 3-points of contact through the feet and hands at all times. In various embodiments, by providing a safer way to perform gas sampling, the present invention can prevent injuries to workers, thereby reducing potential non-productive time.

In various embodiments, the present invention provides a more efficient way to perform gas sampling. In various embodiments, by avoiding leakage of the gas sample, the present invention can provide a high success rate of gas sampling attempts with fewer failed attempts, thereby providing time savings. In addition, fewer failed attempts can result in less wasted chemicals and gas samples, thereby providing savings in the cost of materials used for gas sampling. In various embodiments, by avoiding leakage of the gas sample, the present invention can avoid or reduce the triggering of rig gas alarms which can halt rig operations, thereby increasing operational time of the rig.

Method of Gas Sampling.

In various embodiments, the present invention provides a method of gas sampling. The gas sampling method can include any suitable method of gas sampling using a gas sampling apparatus described herein. The method can include flowing a gas sample from a sample container to a gas trap. The gas trap can include a mud inlet, a mud outlet, and a sample line fluidly connecting the gas trap to a gas detector. The sample container can be fluidly and sealably connected to the gas trap (e.g., the sample container can be in fluid connection with the gas trap, wherein the fluid connection is substantially sealed such that substantially no gas sample leaks out). The method can include flowing the gas sample in the gas trap to the gas detector via the sample line. The method can also include detecting the gas sample with the gas detector.

Detecting the gas sample with the gas detector can be any suitable detecting. Detecting the gas sample with the gas detector can include testing the gas detector (e.g., contacting the gas detector with the gas sample) to ensure it is detecting gases. Detecting the gas sample with the gas detector can include calibrating the gas detector to ensure it is properly identifying the correct type of gas, amount of gas, or a combination thereof.

The sample container can be fluidly and sealably connected to the gas trap. In some embodiments, the method includes fluidly connecting the sample container to the gas trap. In some embodiments, the sample container is fluidly connected to the gas trap before performance of the method.

The gas trap includes an interior space for at least partially separating mud from gas that is entrained in the mud. The gas trap can be a fixed or floating gas trap. Mud including gas enters the bottom of the gas trap via a mud inlet. The mud inlet can be located at a bottom end of the gas trap. The mud including the gas is then subjected to agitation, such as via rotating blades above and proximate to the mud inlet. A mud outlet can be located above the mud inlet, from which mud can be drained from the gas trap. Above the mud outlet, the gas trap can include a headspace that includes the separated gas. The gas trap can include a gas sample outlet to remove a sample of gas from the headspace. The gas trap can include a sample line attached to the gas sample outlet, such that the sample line fluidly connects the gas trap to a gas detector.

The sample container can be fluidly and sealably connected to the gas trap in any suitable way. The sample container can be fluidly and sealably connected to the gas trap via the mud inlet. To prevent the gas sample from exiting the gas trap without being taken into the sample line, other ports on the gas trap can be substantially plugged. For example, during the flowing of the gas sample from the sample container to the gas trap, the mud outlet can be substantially plugged, such as with a cover, a rag, a truncated cylindrical closure, or a truncated conical closure. The method can include substantially plugging the mud outlet. In some embodiments, the mud outlet is plugged prior to beginning the method. In some embodiments, the sample container is fluidly and sealably connected to the gas trap via the mud outlet, with the mud inlet optionally substantially plugged to prevent the gas sample from exiting the mud inlet without being taken into the sample line.

The sealed fluid connection between the sample container and the gas trap can be accomplished in any suitable way. The sample container can be fluidly and sealably connected to the gas trap via tubing between the sample container and the gas trap. The tubing can be any suitable tubing, such as plastic tubing or metal tubing. The tubing can include a removable sealing connector at the end of the tubing that fluidly and sealably connects to the gas trap. For example, the removable sealing connector can be affixed to the tubing. The removable sealing connector can be inserted into and removed from the gas trap. The removable sealing connector forms a seal between the tubing and the gas trap, such that substantially none of the gas sample flowing from the sample container escapes. The removable sealing connector can fluidly, sealably, and removably connect to the mud inlet or the mud outlet of the gas trap.

The removable sealing connector can be any suitable connector that can form a sealed connection to the gas trap and that can be inserted into and removed from the gas trap inlet or the gas trap outlet, such as a truncated cylindrical closure or a truncated conical closure with an orifice therein to fit tubing that leads to the sample container. The outer diameter of the truncated cylindrical or truncated conical closure can securely fit into the mud inlet or mud outlet. The removable sealing connector can be a stopper, a cork, or a bung. The removable sealing connector can be made of a flexible material such as wood (e.g., cork), plastic, or rubber, or an inflexible material such as metal including a rubber seal or gasket around the edge to form a seal with the gas trap mud inlet or mud outlet.

The sample container can be any suitable container that includes or that can generate the gas sample. In some embodiments, the sample container is a reaction chamber, wherein a chemical reaction occurs in the reaction chamber that generates the gas sample. The sample container can include a composition that releases the gas sample upon undergoing a chemical reaction, such as calcium carbide and water which can react to form acetylene gas. The sample container can include a removable lid. The sample container can withstand heat; for example, the sample container can withstand exothermic reactions at up to about 150° C. The sample container can be formed from suitably heatproof plastic, metal, or a combination thereof. The sample container can be thermally insulated. The sample container can include a water dispenser fluidly connected thereto. The water dispenser can be fluidly connected to the sample container via a one-way valve that allows water to flow into the sample container from the water dispenser and that substantially prevents flow from the sample container into the water dispenser (e.g., of water, gas, or both). The sample container can include a composition that releases the gas sample upon contact with water. The method can include placing the composition into the sample container. The method can include flowing water into the sample container from the water dispenser to react with calcium carbide therein to generate acetylene gas.

The sample container can be a gas tank that includes the gas sample therein, such as a "cocktail gas" including a hydrocarbon gas mixture, such as ($C_1$-$C_5$)hydrocarbons. The gas tank can include a valve. The method can include opening the valve to flow the gas sample from inside the gas tank into the gas trap.

Gas Sampling Apparatus.

In various embodiments, the present invention provides a gas sampling apparatus. The gas sampling apparatus can include any suitable apparatus that can be used to perform an embodiment of the method described herein. The gas sampling apparatus can include a sample container configured to flow a gas sample from the sample container to a gas trap. The sample container can be configured to fluidly and sealably connect to the gas trap. The gas trap can include a mud inlet, a mud outlet, and a sample line fluidly connecting the gas trap to a gas detector. The gas trap can be configured to flow the gas sample in the gas trap to the gas detector via the sample line for detection by the gas detector.

The gas detector can be any suitable gas detector. The gas detector can include a mass spectrometer. The gas detector can include a chromatograph, such as a gas chromatograph. The gas detector can include a chromatograph that can be used to separate a gas sample, and a mass spectrometer that can be used to identify and measure the amounts of separated gases. The gas detector can include a total hydrocarbon analyzer (THA).

The gas trap includes an interior space for at least partially separating mud from gas that is entrained in the mud. The gas trap can be a fixed or floating gas trap. The mud inlet can be located at a bottom end of the gas trap. The gas trap can include an agitator, such as rotating blades, above and proximate to the mud inlet. A mud outlet can be located above the mud inlet. Above the mud outlet, the gas trap can include a headspace that includes the separated gas. The gas trap can include a gas sample outlet to remove a sample of gas from the headspace. The gas trap can include a sample line attached to the gas sample outlet, such that the sample line fluidly connects the gas trap to a gas detector.

The sample container can be configured to fluidly and sealably connect to the gas trap in any suitable way. The sample container can be configured to fluidly and sealably connect to the gas trap via the mud inlet. To prevent the gas sample from exiting the gas trap without being taken into the sample line, other ports on the gas trap can be substantially plugged. The mud outlet can be configured to be substantially plugged during the flowing of the gas sample from the sample container to the gas trap, such as with a cover, a rag, a truncated cylindrical closure, or a truncated conical closure (e.g., made of wood, plastic, rubber, or metal) during the flowing of the gas sample from the sample container to the gas trap. The sample container can be configured to fluidly and sealably connect to the gas trap via the mud outlet, with the mud inlet optionally substantially plugged to prevent the gas sample from exiting the mud inlet without being taken into the sample line.

The apparatus can further include tubing, wherein the sample container can be configured to fluidly and sealably connect to the gas trap via the tubing. The apparatus can further include a removable sealing connector. The sample container is configured to fluidly and sealably connect to the gas trap via the removable sealing connector, which can be placed in the mud inlet or the mud outlet of the gas trap. The removable sealing connector can be affixed to the tubing that is fluidly connected to the sample container (e.g., as an end of the tubing). The removable sealing connector can be any suitable connector that can form a sealed connection to the gas trap and that can be inserted into and removed from the gas trap inlet or the gas trap outlet, such as a truncated cylindrical closure or a truncated conical closure with an orifice therein to fit tubing that leads to the sample container. The outer diameter of the truncated cylindrical or truncated conical closure can securely fit into the mud inlet or mud outlet. The removable sealing connector can be a stopper, a cork, or a bung. The removable sealing connector can be made of a flexible material such as wood (e.g., cork), plastic, or rubber, or an inflexible material such as metal including a rubber seal or gasket around the edge to form a seal with the gas trap mud inlet or mud outlet.

The sample container can be any suitable container that includes or that can generate the gas sample. The sample container can be a reaction chamber. The sample container can include a composition that is configured to release the gas sample upon undergoing a chemical reaction (e.g., calcium carbide). The sample container can include a removable lid. The sample container can be thermally insulated. The sample container can include a water dispenser fluidly connected thereto. The water dispenser can be fluidly connected to the sample container via a one-way valve that can be configured to allow water to flow into the sample container from the water dispenser and that can be configured to substantially prevent flow from the sample container into the water dispenser.

The sample container can be a gas tank including a valve. The gas tank can be configured such that opening the valve flows the gas sample from inside the gas tank into the gas trap.

FIG. 1 illustrates an embodiment of a gas sampling apparatus 1000. Dimensions given in FIG. 1 are approximate and are one example of possible dimensions of various aspects of the apparatus. The gas sampling apparatus 1000 can include a sample container 1010 configured to flow a gas sample (not shown) from the sample container 1010 to a gas trap (not shown). The sample container 1010 can be configured to fluidly and sealably connect to the gas trap. The gas trap can include a mud inlet, a mud outlet, and a sample line fluidly connecting the gas trap to a gas detector (not shown). The gas trap can be configured to flow the gas sample in the gas trap to the gas detector via the sample line for detection by the gas detector. The gas sampling apparatus 1000 can include tubing 1020 for dispensing water into the sample container 1010 from a water dispenser (not shown). The tubing 1020 can include a one-way valve 1030 for preventing water, gas, or both, from entering the water dispenser. The sample container 1010 can include a threaded lid 1040*a* and 1040*b* (with side view 1040*a* and top view 1040*b*, with the vertical 1 cm marks on the left and right side of 1040*b* corresponding to the locations at which tubing attaches to the sample container 1010 in a top view). The sample container 1010 can include tubing 1050 that connects the sample container 1010 to the gas trap (not shown) via a removable sealing connector 1060 (e.g., a rubber bung), which can include a hole 1065 to fit the tubing 1050.

Figure 2:
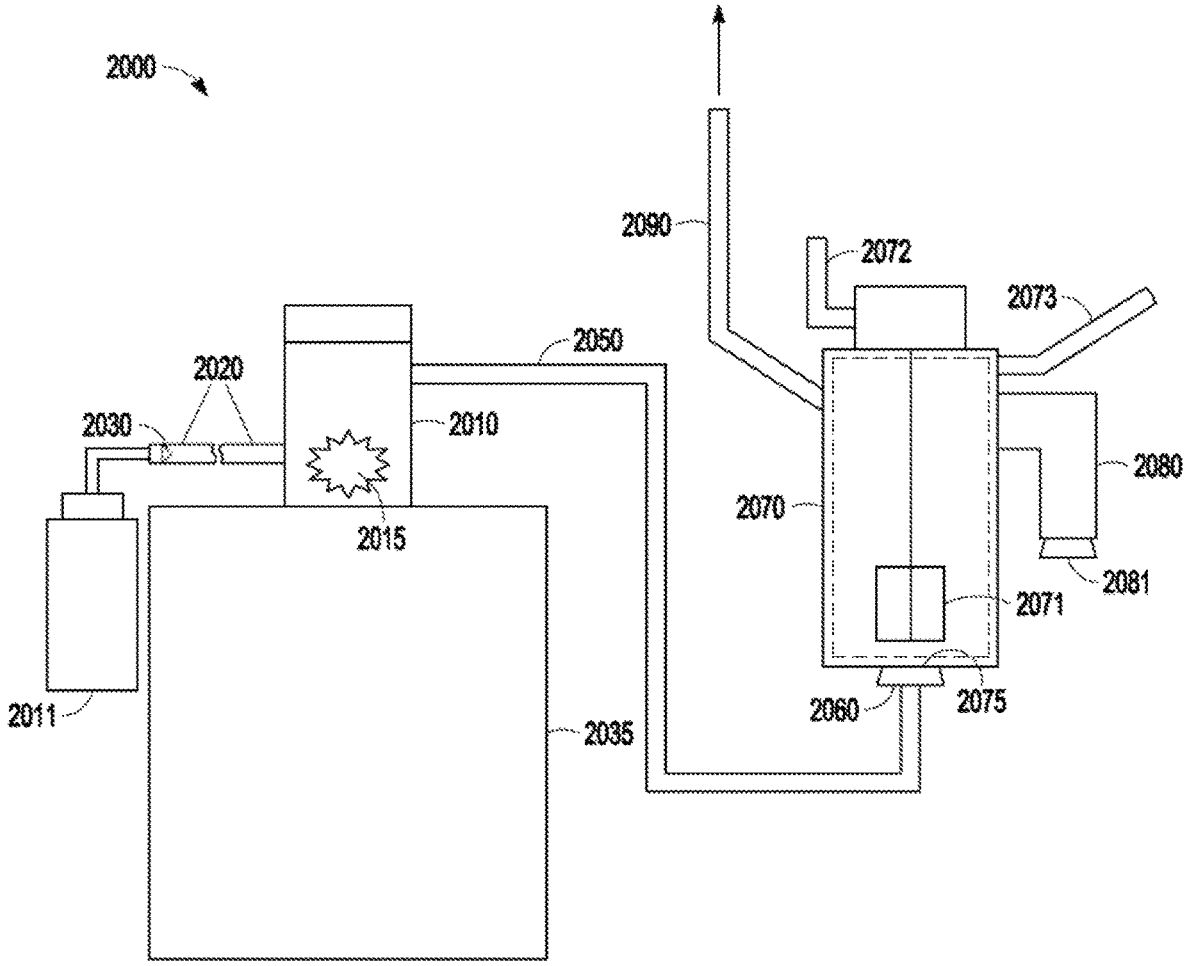
FIG. 2 illustrates a gas sampling apparatus, in accordance with various embodiments.

FIG. 2 illustrates an embodiment of a gas sampling apparatus 2000. The gas sampling apparatus 2000 can include a sample container 2010 including calcium carbide 2015 therein. The sample container 2010 can be configured such that water flowed into the sample container 2010 from a water dispenser 2011 reacts with the calcium carbide 2015 to produce a gas sample (not shown) that flows from the sample container 2010 to a gas trap 2070. The gas trap 2070 includes a mud inlet 2075, a mud outlet 2080, and a sample line 2090 fluidly connecting the gas trap 2070 to a gas detector (not shown). The sample container 2010 can be configured to fluidly and sealably connect to the mud inlet 2075 of the gas trap 2070 via a removable sealing connector 2060. The gas trap 2070 can be configured to flow the gas sample in the gas trap 2070 to the gas detector via the sample line 2090 for detection by the gas detector.

The gas sampling apparatus 2000 can include the water dispenser 2011. The gas sampling apparatus 2000 can include tubing 2020 for dispensing water into the sample container 2010 from the water dispenser 2011. The tubing 2020 can include a one-way valve 2030 for preventing water, gas, or both, from entering the water dispenser 2011. The sample container 2010 can rest on a stable surface 2035. The sample container 2010 can include tubing 2050 that connects the sample container 2010 to the gas trap 2070 via the removable sealing connector 2060 (e.g., a rubber bung).

The gas trap 2070 can be a header box or flowline gas trap. The gas trap 2070 can include rotating gas trap blades 2071. The gas trap 2070 can include a rig air power line 2072, and a spare sample line 2073. The mud outlet 2080 can be blocked with a solid bung 2081. During use, water can be dispensed from the water dispenser 2011 through the tubing 2020 to react with the calcium carbide 2015 in the sample container 2010 to generate acetylene gas (not shown), which is then expelled through the tubing 2050, through the rubber bung 2060, and into the gas trap 2070 via the mud inlet 2075. The gas sample flows from the gas trap 2070 into the sample line 2090 and to a gas detector (not shown) for detection.

Figure 3:
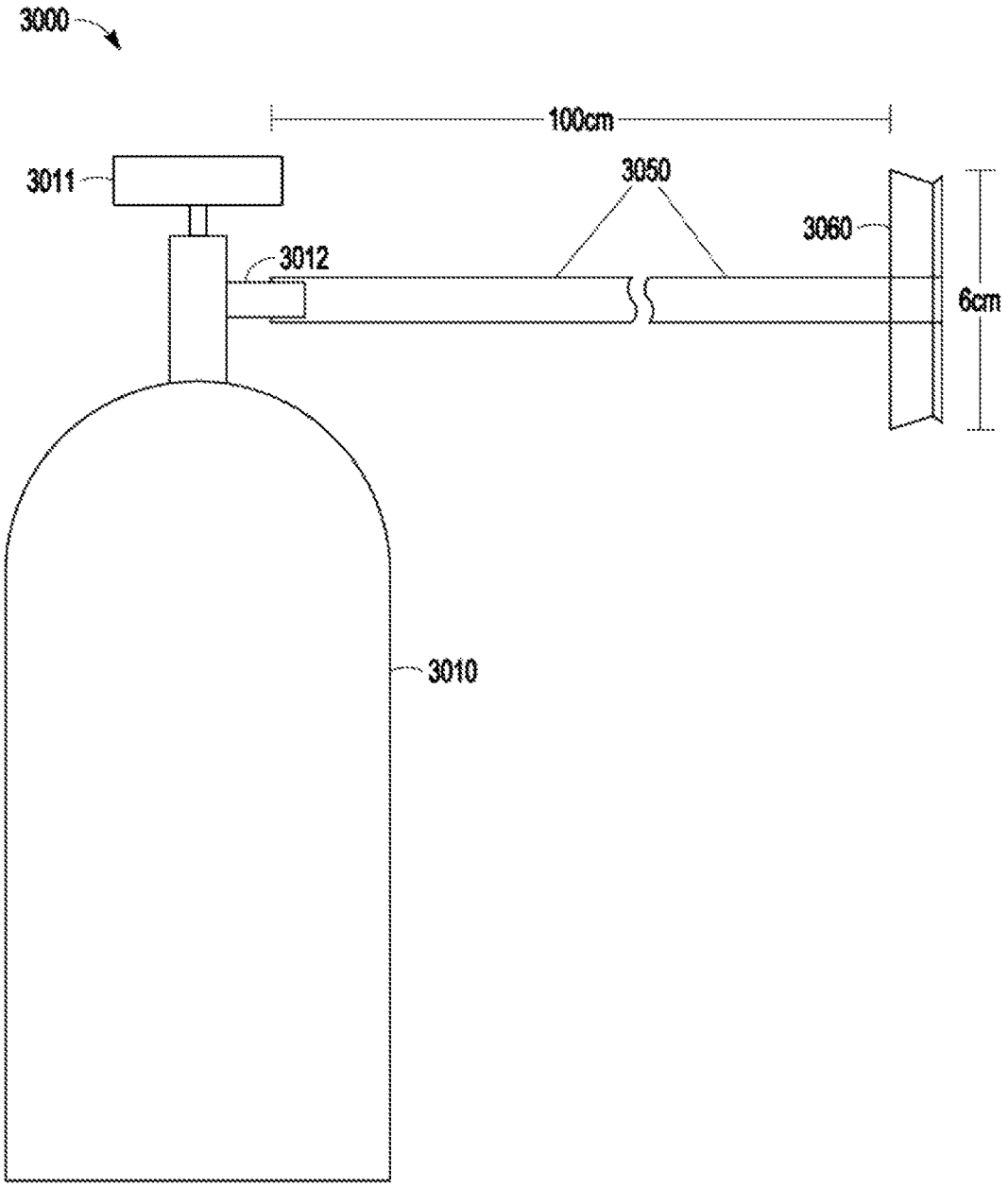
FIG. 3 illustrates a gas sampling apparatus, in accordance with various embodiments.

FIG. 3 illustrates an embodiment of a gas sampling apparatus 3000. Dimensions given in FIG. 3 are approximate and are one example of possible dimensions of various aspects of the apparatus. The gas sampling apparatus 3000 can include a gas tank 3010 including a gas sample therein (not shown). The gas tank 3010 can include a valve 3011. The gas tank 3010 can be configured such that opening the valve 3011 on the gas tank 3010 flows the gas sample from inside the gas tank 3010 into a gas trap (not shown). The gas trap can include a mud inlet, a mud outlet, and a sample line fluidly connecting the gas trap to a gas detector (not shown). The gas tank 3010 can be configured to fluidly and sealably connect to the mud inlet or the mud outlet of the gas trap via a removable sealing connector 3060 on the end of tubing 3050. The gas trap can be configured to flow the gas sample in the gas trap to the gas detector via the sample line for detection by the gas detector. The gas tank 3010 can contain a "cocktail gas" including ($C_1$-$C_5$)hydrocarbons. The valve 3011 can be a needle valve. The tubing 3050 can fit over a sleeve 3012 of the valve 3011.

Drilling Fluid.

A drilling fluid, also known as a drilling mud or simply "mud," is a specially designed fluid that is circulated through a wellbore as the wellbore is being drilled to facilitate the drilling operation. The drilling fluid can be water-based or oil-based. The drilling fluid can carry cuttings up from beneath and around the bit, transport them up the annulus, and allow their separation. Also, the drilling fluid can cool and lubricate the drill bit as well as reduce friction between the drill string and the sides of the hole. The drilling fluid aids in support of the drill pipe and drill bit, and provides a hydrostatic head to maintain the integrity of the wellbore walls and prevent well blowouts. Specific drilling fluid systems can be selected to optimize a drilling operation in accordance with the characteristics of a particular geological formation. The drilling fluid can be formulated to prevent unwanted influxes of formation fluids from permeable rocks and also to form a thin, low permeability filter cake that temporarily seals pores, other openings, and formations penetrated by the bit. In water-based drilling fluids, solid particles are suspended in a water or brine solution containing other components. Oils or other non-aqueous liquids can be emulsified in the water or brine or at least partially solubilized (for less hydrophobic non-aqueous liquids), but water is the continuous phase.

A water-based drilling fluid in embodiments of the present invention can be any suitable water-based drilling fluid. In various embodiments, the drilling fluid can include at least one of water (fresh or brine), a salt (e.g., calcium chloride, sodium chloride, potassium chloride, magnesium chloride, calcium bromide, sodium bromide, potassium bromide, calcium nitrate, sodium formate, potassium formate, or cesium formate), aqueous base (e.g., sodium hydroxide or potassium hydroxide), alcohol or polyol, cellulose, starches, alkalinity control agents, density control agents such as a density modifier (e.g., barium sulfate), surfactants (e.g., betaines, alkali metal alkylene acetates, sultaines, or ether carboxylates), emulsifiers, dispersants, polymeric stabilizers, crosslinking agents, polyacrylamides, polymers or combinations of polymers, antioxidants, heat stabilizers, foam control agents, solvents, diluents, plasticizers, filler or inorganic particles (e.g., silica), pigments, dyes, precipitating agents (e.g., silicates or aluminum complexes), and rheology modifiers such as thickeners or viscosifiers (e.g., xanthan gum, laponite gels, geltones, sepiolite gel, or TAU-MOD®). Any ingredient listed in this paragraph can be either present or not present in the mixture.

An oil-based drilling fluid or mud in embodiments of the present invention can be any suitable oil-based drilling fluid. In various embodiments, the drilling fluid can include at least one of an oil-based fluid (or synthetic fluid), saline, aqueous solution, emulsifiers, other agents or additives for suspension control, weight or density control, oil-wetting agents, fluid loss or filtration control agents, and rheology control agents. An oil-based or invert emulsion-based drilling fluid can include between about 10:90 to about 95:5, or about 50:50 to about 95:5, by volume of oil phase to water phase. A substantially all oil mud includes about 100% liquid phase oil by volume (e.g., substantially no internal aqueous phase).

The drilling fluid can include any suitable carrier fluid, such as crude oil, dipropylene glycol methyl ether, dipropylene glycol dimethyl ether, dipropylene glycol methyl ether, dipropylene glycol dimethyl ether, dimethyl formamide, diethylene glycol methyl ether, ethylene glycol butyl ether, diethylene glycol butyl ether, butylglycidyl ether, propylene carbonate, D-limonene, a $C_2$-$C_{40}$ fatty acid $C_1$-$C_{10}$ alkyl ester (e.g., a fatty acid methyl ester), tetrahydrofurfuryl methacrylate, tetrahydrofurfuryl acrylate, 2-butoxy ethanol, butyl acetate, butyl lactate, furfuryl acetate, dimethyl sulfoxide, dimethyl formamide, a petroleum distillation product or fraction (e.g., diesel, kerosene, napthas, and the like) mineral oil, a hydrocarbon oil, a hydrocarbon including an aromatic carbon-carbon bond (e.g., benzene, toluene), a hydrocarbon including an alpha olefin, xylenes, an ionic liquid, methyl ethyl ketone, an ester of oxalic, maleic or succinic acid, methanol, ethanol, propanol (iso- or normal-), butyl alcohol (iso-, tert-, or normal-), an aliphatic hydrocarbon (e.g., cyclohexanone, hexane), water, brine, produced water, flowback water, brackish water, and sea water. The carrier fluid can form about 0.001 wt % to about 99.999 wt % of the drilling fluid, or about 0.001 wt % or less, or less than, equal to, or greater than about 0.01 wt %, 0.1, 1, 2, 3, 4, 5, 6, 8, 10, 15, 20, 25, 30, 35, 40, 45, 50, 55, 60, 65, 70, 75, 80, 85, 90, 95, 96, 97, 98, 99, 99.9, 99.99, or about 99.999 wt % or more.

In some embodiments, the drilling fluid can include any suitable amount of any suitable material used in a downhole fluid. For example, the drilling fluid can include water, saline, aqueous base, acid, oil, organic solvent, synthetic fluid oil phase, aqueous solution, alcohol or polyol, cellulose, starch, alkalinity control agents, acidity control agents, density control agents, density modifiers, emulsifiers, dispersants, polymeric stabilizers, polyacrylamide, a polymer or combination of polymers, antioxidants, heat stabilizers, foam control agents, solvents, diluents, plasticizer, filler or inorganic particle, pigment, dye, precipitating agent, oil-wetting agents, set retarding additives, surfactants, gases, weight reducing additives, heavy-weight additives, lost circulation materials, filtration control additives, salts (e.g., any suitable salt, such as potassium salts such as potassium chloride, potassium bromide, or potassium formate; calcium salts such as calcium chloride, calcium bromide, or calcium formate; cesium salts such as cesium chloride, cesium bromide, or cesium formate; or a combination thereof), fibers, thixotropic additives, breakers, crosslinkers, rheology modifiers, curing accelerators, curing retarders, pH modifiers, chelating agents, scale inhibitors, enzymes, resins, water control materials, oxidizers, markers, Portland cement, pozzolana cement, gypsum cement, high alumina content cement, slag cement, silica cement, fly ash, metakaolin, shale, zeolite, a crystalline silica compound, amorphous silica, hydratable clays, microspheres, lime, or a combination thereof. In various embodiments, the drilling fluid can include one or more additive components such as COLDTROL®, ATC®, OMC 2™, and OMC 42™ thinner additives; RHEMOD™ viscosifier and suspension agent; TEMPERUS™ and VIS-PLUS® additives for providing temporary increased viscosity; TAU-MOD™ viscosifying/suspension agent; ADAPTA®, DURATONE® HT, THERMO TONE™, BDF™-366, and BDF™-454 filtration control agents; LIQUITONE™ polymeric filtration agent and viscosifier; FACTANT™ emulsion stabilizer; LE SUPERMUL™, EZ MUL® NT, and FORTI-MUL® emulsifiers; DRIL TREAT® oil wetting agent for heavy fluids; AQUATONE-S™ wetting agent; BARACARB® bridging agent; BAROID® weighting agent; BAROLIFT® hole sweeping agent; SWEEP-WATE® sweep weighting agent; BDF-508 rheology modifier; and GELTONE® II organophilic clay. In various embodiments, the drilling fluid can include one or more additive components such as X-TEND® II, PAC™-R, PAC™-L, LIQUI-VIS® EP, BRINEDRIL-VIS™, BARAZAN®, N-VIS®, and AQUA-GEL® viscosifiers; THERMA-CHEK®, N-DRIL™, N-DRIL™ HT PLUS, IMPERMEX®, FILTERCHEK™, DEXTRID®, CARBONOX®, and BARANEX® filtration control agents; PERFORMATROL®, GEM™, EZ-MUD®, CLAY GRABBER®, CLAYSEAL®, CRYSTAL-DRIL®, and CLAY SYNC™ II shale stabilizers; NXS-LUBE™, EP MUDLUBE®, and DRIL-N-SLIDE™ lubricants; QUIK-THIN®, IRON-THIN™, THERMA-THIN®, and ENVIRO-THIN™ thinners; SOURSCAV™ scavenger; BARACOR® corrosion inhibitor; and WALL-NUT®, SWEEP-WATE®, STOPPIT™, PLUG-GIT®, BARACARB®, DUO-SQUEEZE®, BAROFIBRE™, STEEL-SEAL®, and HYDRO-PLUG® lost circulation management materials. Any suitable proportion of the drilling fluid can include any optional component listed in this paragraph, such as about 0.001 wt % to about 99.999 wt %, about 0.01 wt % to about 99.99 wt %, about 0.1 wt % to about 99.9 wt %, about 20 wt % to about 90 wt %, or about 0.001 wt % or less, or less than, equal to, or greater than about 0.01 wt %, 0.1, 1, 2, 3, 4, 5, 10, 15, 20, 30, 40, 50, 60, 70, 80, 85, 90, 91, 92, 93, 94, 95, 96, 97, 98, 99, 99.9, 99.99 wt %, or about 99.999 wt % or more.

Drilling Assembly.

Figure 4:
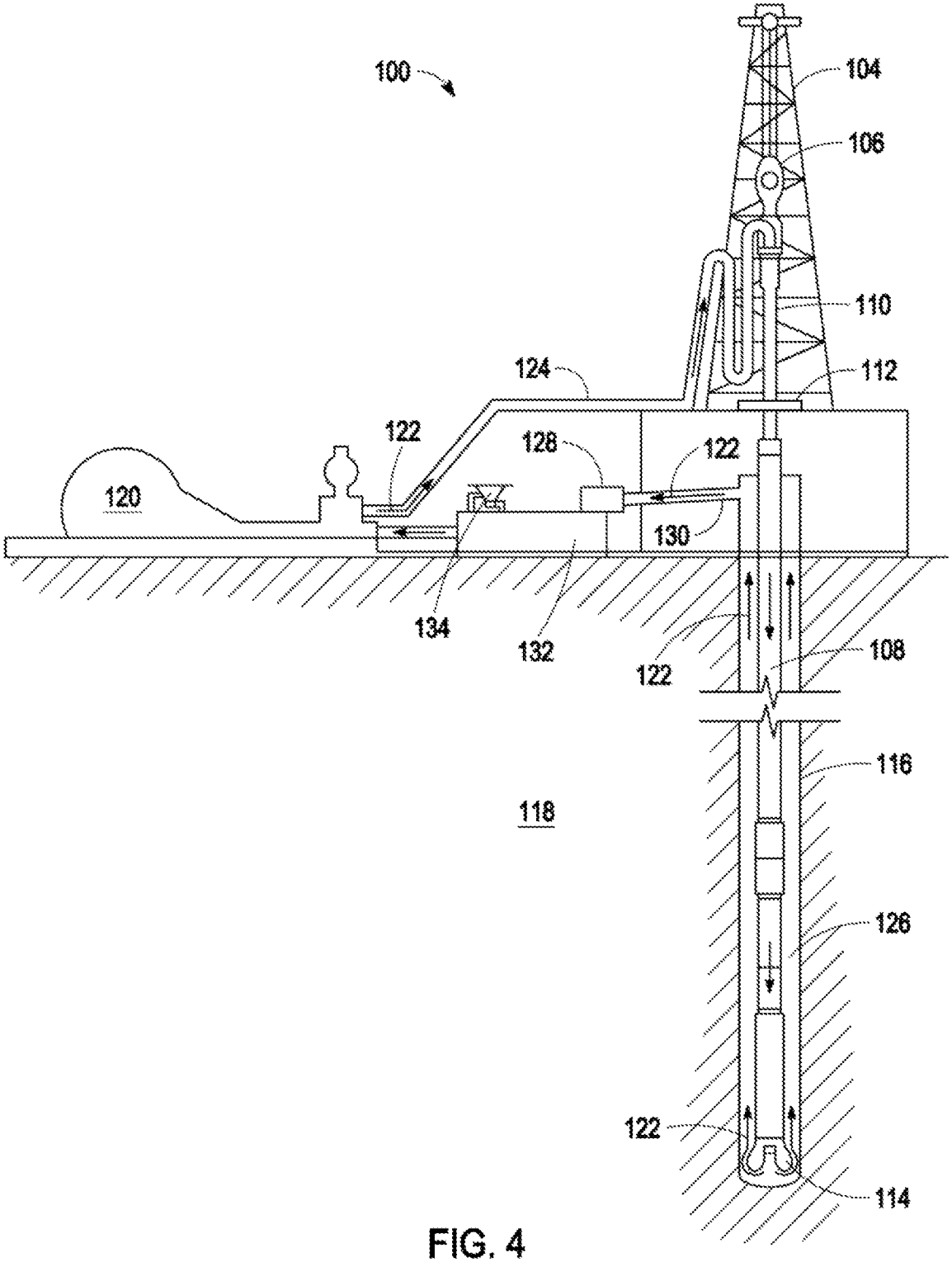
FIG. 4 illustrates a drilling assembly, in accordance with various embodiments.

In various embodiments, the gas trap of the method, apparatus, or system can be part of a drilling assembly. For example, and with reference to FIG. 4, the gas trap can be used together with one or more components or pieces of equipment associated with an exemplary wellbore drilling assembly 100, according to one or more embodiments. It should be noted that while FIG. 4 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 100 can include a drilling platform 102 that supports a derrick 104 having a traveling block 106 for raising and lowering a drill string 108. The drill string 108 can include drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a wellbore 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and can be conveyed to one or more fluid processing unit(s) 128 via an interconnecting flow line 130. The unit 128 can be a gas trap that at least partially separates the mud from gas entrained therein (e.g., a header box gas trap that is behind the shale shakers, with mud passing therethrough before the rock cuttings and sand have been separated from the mud). After passing through the fluid processing unit(s) 128, a "cleaned" drilling fluid 122 is deposited into a nearby retention pit 132 (e.g., a mud pit). While the fluid processing unit(s) 128 is illustrated as being arranged at the outlet of the wellbore 116 via the annulus 126, those skilled in the art will readily appreciate that the fluid processing unit(s) 128 can be arranged at any other location in the drilling assembly 100 to facilitate its proper function, without departing from the scope of the disclosure.

The pump 120 can be a high pressure pump in some embodiments. As used herein, the term "high pressure pump" will refer to a pump that is capable of delivering a fluid to a subterranean formation (e.g., downhole) at a pressure of about 1000 psi or greater. Suitable high pressure pumps will be known to one having ordinary skill in the art and can include floating piston pumps and positive displacement pumps. In other embodiments, the pump 120 can be a low pressure pump. As used herein, the term "low pressure pump" will refer to a pump that operates at a pressure of about 1000 psi or less. In some embodiments, a low pressure pump can be fluidly coupled to a high pressure pump that is fluidly coupled to the drill string. That is, in such embodiments, the low pressure pump can be configured to convey the drilling fluid to the high pressure pump. In such embodiments, the low pressure pump can "step up" the pressure of the drilling fluid before it reaches the high pressure pump.

A mixing hopper 134 is communicably coupled to or otherwise in fluid communication with the retention pit 132. The mixing hopper 134 can include mixers and related mixing equipment known to those skilled in the art. In at least one embodiment, for example, there could be more than one retention pit 132, such as multiple retention pits 132 in series.

The fluid processing unit(s) 128 can include one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, or any fluid reclamation equipment. The fluid processing unit(s) 128 can further include one or more sensors, gauges, pumps, compressors, and the like used to store, monitor, regulate, and/or recondition the drilling fluid.

The pump 120 representatively includes any conduits, pipelines, trucks, tubulars, and/or pipes used to fluidically convey the drilling fluid to the subterranean formation; any pumps, compressors, or motors (e.g., topside or downhole) used to drive the drilling fluid into motion; any valves or related joints used to regulate the pressure or flow rate of the drilling fluid; any sensors (e.g., pressure, temperature, flow rate, and the like), gauges, and/or combinations thereof; and the like.

The drilling apparatus can include any suitable equipment or tools used for drilling the subterranean formation. Such equipment and tools can include wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, other wellbore isolation devices or components, and the like. Any of these components can be included in the systems and apparatus generally described above and depicted in FIG. 4.

System for Gas Sampling.

In various embodiments, the present invention provides a system for gas sampling. The system can be any suitable system that can perform an embodiment of the method of gas sampling described herein, or that includes an embodiment of the gas sampling apparatus described herein.

The system can include a gas detector. The system can include a gas trap including a mud inlet, a mud outlet, and a sample line fluidly connecting the gas trap to the gas detector. The system can include a sample container that is fluidly and sealably connected to the gas trap. The sample container can be configured to flow a gas sample from the sample container to the gas trap. The gas trap can be configured to flow the gas sample in the gas trap to the gas detector via the sample line for detection by the gas detector.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments

The following exemplary embodiments are provided, the numbering of which is not to be construed as designating levels of importance:

Embodiment 1 provides a method of gas sampling, the method comprising:

flowing a gas sample from a sample container to a gas trap, the gas trap comprising
- a mud inlet,
- a mud outlet, and
- a sample line fluidly connecting the gas trap to a gas detector,
- wherein the sample container is fluidly and sealably connected to the gas trap; flowing the gas sample in the gas trap to the gas detector via the sample line; and detecting the gas sample with the gas detector.

Embodiment 2 provides the method of Embodiment 1, further comprising fluidly connecting the sample container to the gas trap.

Embodiment 3 provides the method of any one of Embodiments 1-2, wherein detecting the gas sample with the gas detector comprises testing the gas detector with the gas sample.

Embodiment 4 provides the method of any one of Embodiments 1-3, wherein detecting the gas sample with the gas detector comprises calibrating the gas detector with the gas sample.

Embodiment 5 provides the method of any one of Embodiments 1-4, wherein the mud inlet is located at a bottom end of the gas trap.

Embodiment 6 provides the method of any one of Embodiments 1-5, wherein the mud inlet is located below the mud outlet on the gas trap.

Embodiment 7 provides the method of any one of Embodiments 1-6, wherein the mud inlet is proximate to an agitator in the gas trap.

Embodiment 8 provides the method of any one of Embodiments 1-7, wherein the sample container is fluidly and sealably connected to the gas trap via the mud inlet.

Embodiment 9 provides the method of Embodiment 8, wherein during the flowing of the gas sample from the sample container to the gas trap, the mud outlet is substantially plugged.

Embodiment 10 provides the method of Embodiment 9, wherein the mud outlet is plugged with a cover, a rag, a truncated cylindrical closure, or a truncated conical closure.

Embodiment 11 provides the method of any one of Embodiments 8-10, further comprising plugging the mud outlet.

Embodiment 12 provides the method of any one of Embodiments 1-11, wherein the sample container is fluidly and sealably connected to the gas trap via the mud outlet.

Embodiment 13 provides the method of any one of Embodiments 1-12, wherein the sample container is fluidly and sealably connected to the gas trap via tubing.

Embodiment 14 provides the method of any one of Embodiments 1-13, wherein the sample container is fluidly and sealably connected to the gas trap via a removable sealing connector.

Embodiment 15 provides the method of Embodiment 14, wherein the removable sealing connector is removably and sealably secured in the mud inlet or the mud outlet.

Embodiment 16 provides the method of any one of Embodiments 14-15, wherein the removable sealing connector is affixed to tubing that is fluidly connected to the sample container.

Embodiment 17 provides the method of any one of Embodiments 14-16, wherein the removable sealing connector comprises a truncated cylindrical closure or a truncated conical closure.

Embodiment 18 provides the method of any one of Embodiments 14-17, wherein the removable sealing connector is a bung.

Embodiment 19 provides the method of any one of Embodiments 1-18, wherein the sample container is a reaction chamber.

Embodiment 20 provides the method of Embodiment 19, wherein the sample container comprises a composition that releases the gas sample upon undergoing a chemical reaction.

Embodiment 21 provides the method of any one of Embodiments 19-20, wherein the sample container comprises a removable lid.

Embodiment 22 provides the method of any one of Embodiments 19-21, wherein the sample container is thermally insulated.

Embodiment 23 provides the method of any one of Embodiments 19-22, wherein the sample container comprises a water dispenser fluidly connected thereto.

Embodiment 24 provides the method of Embodiment 23, wherein the water dispenser is fluidly connected to the sample container via a one-way valve that allows water to flow into the sample container from the water dispenser and that substantially prevents flow from the sample container into the water dispenser.

Embodiment 25 provides the method of any one of Embodiments 19-24, wherein the sample container comprises a composition that releases the gas sample upon contact with water.

Embodiment 26 provides the method of any one of Embodiments 19-25, wherein the sample container comprises calcium carbide.

Embodiment 27 provides the method of any one of Embodiments 19-26, further comprising flowing water into the sample container to react with a composition therein to produce the gas sample.

Embodiment 28 provides the method of any one of Embodiments 1-27, wherein the sample container is a gas tank comprising a valve.

Embodiment 29 provides the method of Embodiment 28, further comprising opening the valve to flow the gas sample from inside the gas tank into the gas trap.

Embodiment 30 provides a system for performing the method of any one of Embodiments 1-29, the system comprising:

the sample container;

the gas trap; and the gas detector.

Embodiment 31 provides a method of gas sampling, the method comprising:

flowing water into a sample container to react with calcium carbide therein to produce a gas sample;

flowing the gas sample from the sample container to a gas trap, the gas trap comprising a mud inlet, a mud outlet, and a sample line fluidly connecting the gas trap to a gas detector, wherein the sample container is fluidly and sealably connected to the mud inlet or the mud outlet of the gas trap via a removable sealing connector;

flowing the gas sample in the gas trap to the gas detector via the sample line; and detecting the gas sample with the gas detector.

Embodiment 32 provides a method of gas sampling, the method comprising:

opening a valve on a gas tank to flow a gas sample from inside the gas tank into a gas trap, the gas trap comprising a mud inlet, a mud outlet, and a sample line fluidly connecting the gas trap to a gas detector, wherein the gas tank is fluidly and sealably connected to the mud inlet or the mud outlet of the gas trap via a removable sealing connector;

flowing the gas sample in the gas trap to the gas detector via the sample line; and detecting the gas sample with the gas detector.

Embodiment 33 provides a gas sampling apparatus comprising:

a sample container configured to flow a gas sample from the sample container to a gas trap, wherein the sample container is configured to fluidly and sealably connect to the gas trap, the gas trap comprising a mud inlet, a mud outlet, and a sample line fluidly connecting the gas trap to a gas detector, wherein the gas trap is configured to flow the gas sample in the gas trap to the gas detector via the sample line for detection by the gas detector.

Embodiment 34 provides the apparatus of Embodiment 33, wherein the mud inlet is located at a bottom end of the gas trap.

Embodiment 35 provides the apparatus of any one of Embodiments 33-34, wherein the mud inlet is located below the mud outlet on the gas trap.

Embodiment 36 provides the apparatus of any one of Embodiments 33-35, wherein the mud inlet is proximate to an agitator in the gas trap.

Embodiment 37 provides the apparatus of any one of Embodiments 33-36, wherein the sample container is configured to fluidly and sealably connect to the gas trap via the mud inlet.

Embodiment 38 provides the apparatus of Embodiment 37, wherein the mud outlet is configured to be substantially plugged during the flowing of the gas sample from the sample container to the gas trap.

Embodiment 39 provides the apparatus of any one of Embodiments 37-38, wherein the mud outlet is configured to be substantially plugged with a cover, a rag, a truncated cylindrical closure, or a truncated conical closure during the flowing of the gas sample from the sample container to the gas trap.

Embodiment 40 provides the apparatus of any one of Embodiments 33-39, wherein the sample container is configured to fluidly and sealably connect to the gas trap via the mud outlet.

Embodiment 41 provides the apparatus of any one of Embodiments 33-40, further comprising tubing, wherein the sample container is configured to fluidly and sealably connect to the gas trap via the tubing.

Embodiment 42 provides the apparatus of any one of Embodiments 33-41, further comprising a removable sealing connector, wherein the sample container is configured to fluidly and sealably connect to the gas trap via the removable sealing connector.

Embodiment 43 provides the apparatus of Embodiment 42, wherein the sample container is configured to fluidly and sealably connect to the gas trap via the removable sealing connector in the mud inlet or the mud outlet.

Embodiment 44 provides the apparatus of any one of Embodiments 42-43, wherein the removable sealing connector is affixed to tubing that is fluidly connected to the sample container.

Embodiment 45 provides the apparatus of any one of Embodiments 42-44, wherein the removable sealing connector comprises a truncated cylindrical closure or a truncated conical closure.

Embodiment 46 provides the apparatus of any one of Embodiments 42-45, wherein the removable sealing connector is a bung.

Embodiment 47 provides the apparatus of any one of Embodiments 33-46, wherein the sample container is a reaction chamber.

Embodiment 48 provides the apparatus of Embodiment 47, wherein the sample container comprises a composition that is configured to release the gas sample upon undergoing a chemical reaction.

Embodiment 49 provides the apparatus of any one of Embodiments 47-48, wherein the sample container comprises a removable lid.

Embodiment 50 provides the apparatus of any one of Embodiments 47-49, wherein the sample container is thermally insulated.

Embodiment 51 provides the apparatus of any one of Embodiments 47-50, wherein the sample container comprises a water dispenser fluidly connected thereto.

Embodiment 52 provides the apparatus of Embodiment 51, wherein the water dispenser is fluidly connected to the sample container via a one-way valve that is configured to allow water to flow into the sample container from the water dispenser and that is configured to substantially prevent flow from the sample container into the water dispenser.

Embodiment 53 provides the apparatus of any one of Embodiments 47-52, wherein the sample container comprises a composition that releases the gas sample upon contact with water.

Embodiment 54 provides the apparatus of any one of Embodiments 47-53, wherein the sample container comprises calcium carbide.

Embodiment 55 provides the apparatus of any one of Embodiments 33-54, wherein the sample container is a gas tank comprising a valve.

Embodiment 56 provides the apparatus of Embodiment 55, wherein the gas tank is configured such that opening the valve flows the gas sample from inside the gas tank into the gas trap.

Embodiment 57 provides a system for gas sampling using the apparatus of any one of Embodiments 33-56, the system comprising:

the sample container;

the gas trap; and the gas detector.

Embodiment 58 provides a gas sampling apparatus comprising:

a sample container comprising calcium carbide therein, the sample container configured such that water flowed into the sample container reacts with the calcium carbide to produce a gas sample that flows from the sample container to a gas trap, the gas trap comprising a mud inlet, a mud outlet, and a sample line fluidly connecting the gas trap to a gas detector, wherein the sample container is configured to fluidly and sealably connect to the mud inlet or the mud outlet of the gas trap via a removable sealing connector, and the gas trap is configured to flow the gas sample in the gas trap to the gas detector via the sample line for detection by the gas detector.

Embodiment 59 provides a gas sampling apparatus comprising:

a gas tank comprising a gas sample therein and a valve, the gas tank configured such that opening the valve on the gas tank flows a gas sample from inside the gas tank into a gas trap, the gas trap comprising a mud inlet, a mud outlet, and a sample line fluidly connecting the gas trap to a gas detector, wherein the gas tank is configured to fluidly and sealably connect to the mud inlet or the mud outlet of the gas trap via a removable sealing connector, and the gas trap is configured to flow the gas sample in the gas trap to the gas detector via the sample line for detection by the gas detector.

Embodiment 60 provides a system for gas sampling, the system comprising:

a gas detector;

a gas trap comprising a mud inlet, a mud outlet, and a sample line fluidly connecting the gas trap to the gas detector; and a sample container that is fluidly and sealably connected to the gas trap, wherein the sample container is configured to flow a gas sample from the sample container to the gas trap, wherein the gas trap is configured to flow the gas sample in the gas trap to the gas detector via the sample line for detection by the gas detector.

Embodiment 61 provides the method, apparatus, or system of any one or any combination of Embodiments 1-60 optionally configured such that all elements or options recited are available to use or select from.

What is claimed is:

1. A method of gas sampling, the method comprising:

flowing a gas sample from a sample container to a gas trap, the gas trap comprising a mud inlet, a mud outlet, and a sample line fluidly connecting the gas trap to a gas detector, wherein the sample container is fluidly and sealably connected to the gas trap, such that the sample container is in fluid connection with the gas trap and the fluid connection is substantially sealed such that substantially no gas sample leaks out;

flowing the gas sample in the gas trap to the gas detector via the sample line; and detecting the gas sample with the gas detector;

wherein the sample container is a reaction chamber.

2. The method of claim 1, wherein the mud inlet is located below the mud outlet on the gas trap.

3. The method of claim 1, wherein the mud inlet is proximate to an agitator in the gas trap.

4. The method of claim 1, wherein the sample container is fluidly and sealably connected to the gas trap via the mud inlet or the mud outlet.

5. The method of claim 1, wherein the sample container is fluidly and sealably connected to the gas trap via tubing.

6. The method of claim 1, wherein the sample container is fluidly and sealably connected to the gas trap via a removable sealing connector.

7. The method of claim 6, wherein the removable sealing connector is removably and sealably secured in the mud inlet or the mud outlet.

8. The method of claim 6, wherein the removable sealing connector is affixed to tubing that is fluidly connected to the sample container.

9. The method of claim 6, wherein the removable sealing connector comprises a truncated cylindrical closure or a truncated conical closure.

10. The method of claim 1, wherein the sample container comprises a removable lid.

11. The method of claim 1, wherein the sample container comprises a water dispenser fluidly connected thereto.

12. The method of claim 11, wherein the water dispenser is fluidly connected to the sample container via a one-way valve that allows water to flow into the sample container from the water dispenser and that substantially prevents flow from the sample container into the water dispenser.

13. The method of claim 1, wherein the sample container comprises a composition that releases the gas sample upon contact with water.

14. The method of claim 1, wherein the sample container comprises calcium carbide.

15. The method of claim 1, further comprising flowing water into the sample container to react with a composition therein to produce the gas sample.

16. A gas sampling apparatus comprising:

a sample container configured to flow a gas sample from the sample container to a gas trap, wherein the sample container is configured to fluidly and sealably connect to the gas trap such that the sample container is in fluid connection with the gas trap and the fluid connection is substantially sealed such that substantially no gas sample leaks out, the gas trap comprising a mud inlet, a mud outlet, and a sample line fluidly connecting the gas trap to a gas detector, wherein the gas trap is configured to flow the gas sample in the gas trap to the gas detector via the sample line for detection by the gas detector; and wherein the sample container is a reaction chamber.

17. A system for gas sampling, the system comprising:

a gas detector;

a gas trap comprising a mud inlet, a mud outlet, and a sample line fluidly connecting the gas trap to the gas detector; and a sample container that is fluidly and sealably connected to the gas trap such that the sample container is in fluid connection with the gas trap and the fluid connection is substantially sealed such that substantially no gas sample leaks out, wherein the sample container is configured to flow a gas sample from the sample container to the gas trap, wherein the gas trap is configured to flow the gas sample in the gas trap to the gas detector via the sample line for detection by the gas detector;

wherein the sample container is a reaction chamber.

* * * * *